US007987692B2

(12) United States Patent
Kiefer, Jr. et al.

(10) Patent No.: US 7,987,692 B2
(45) Date of Patent: Aug. 2, 2011

(54) DOOR LEVELER

(75) Inventors: John D. Kiefer, Jr., San Antonio, TX (US); Patrick S. Mckinney, Devine, TX (US); Jose Gonzalez, Jr., Elmendorf, TX (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 12/543,693

(22) Filed: Aug. 19, 2009

(65) Prior Publication Data

US 2011/0041584 A1 Feb. 24, 2011

(51) Int. Cl.
*B21J 13/08* (2006.01)
*B21D 1/12* (2006.01)

(52) U.S. Cl. ..... 72/458; 72/479; 72/705; 29/267; D8/88

(58) Field of Classification Search ..... 72/458, 72/459, 477, 479, 705; 29/267, 271; D8/88
See application file for complete search history.

(56) References Cited

U.S. PATENT DOCUMENTS

| | | | | |
|---|---|---|---|---|
| 4,399,683 | A | 8/1983 | Hunter | |
| 4,555,929 | A | 12/1985 | McBee | |
| 4,619,132 | A | 10/1986 | McBee | |
| 4,744,135 | A | 5/1988 | Roels | |
| 4,930,337 | A * | 6/1990 | Schaap | 72/458 |
| 5,331,837 | A | 7/1994 | Stuhlmacher, II | |
| D368,839 | S | 4/1996 | Hunter | |
| 5,562,001 | A | 10/1996 | Bell | |
| 6,772,495 | B1 | 8/2004 | Gerhards | |
| D513,954 | S | 1/2006 | Richards | |
| 7,040,135 | B2 | 5/2006 | Stuhlmacher, II | |

* cited by examiner

*Primary Examiner* — David B Jones
(74) *Attorney, Agent, or Firm* — Gifford, Krass, Sprinkle, Anderson & Citkowski, P.C.

(57) ABSTRACT

An apparatus for aligning and leveling an associated vehicle door having an elongated member, a head member attached to said elongated member adapted to engage a vehicle door lock recess, a support member extending downwardly from said elongated member towards a vehicle door and a support plate attached to said support member adapted to rest on said vehicle door. The apparatus is designed to aid in the leveling and aligning processes of a vehicle door after assembly of the vehicle. The elongated member may include a series of bends to improve the ergonomic efficiency of the vehicle door leveler.

21 Claims, 3 Drawing Sheets

DOOR LEVELER

FIELD OF THE INVENTION

The present invention relates to autobody tools, in particular, to a vehicle door aligning and leveling tool.

BACKGROUND OF THE INVENTION

It is a common problem in automotive vehicles that the hinged door of an automotive vehicle is misaligned during the initial manufacture. This misalignment causes the door to not properly close or be misaligned when closed. Misalignment may cause air gaps in the seal of a closed vehicle door leading to noise heard by the driver, among other problems.

Overcoming such a misalignment is often completed by a mechanic or other automotive worker by applying a force to the lower portion of the vehicle door to improve its alignment. This may be accomplished generally by the crude method of grabbing a vehicle door with the hands and pushing or pulling on the vehicle door to improve alignment of the vehicle door. The method of grabbing a vehicle door with the hands often results in injury to assembly plant workers or other automotive workers. This method can often damage the vehicle door by either damaging the paint or leaving an indentation in the bottom of the vehicle door.

It is one object of the present invention to provide an improved alignment tool which can be used to apply force to the vehicle door without the danger of damaging the surface of the vehicle door. It is another object of the invention to provide an apparatus which avoids scratching or damaging of any paint or any deformation of any vehicle door structure.

Yet another method of alignment involves kneeling on the ground and pulling or pushing the bottom of the vehicle door with hands to level and align the vehicle door. Again, this method often results in injury to assembly plant workers or other automotive workers.

Another object of the present invention is to minimize risk of injury to assembly plant workers or other automotive workers when aligning a vehicle door by means of using their hands or knees when aligning the vehicle door.

Vehicle door designs often vary greatly in different models and makes of vehicles. It is an object of the invention to provide an apparatus which is simple and universal to all automotive vehicle doors and structures. It is another object of the invention to provide an apparatus which will cooperate with a wide variety of automobile and vehicle structures.

Accordingly there exists a need for a tool more suitable for correcting common misalignment and level problems in vehicle doors.

SUMMARY OF THE INVENTION

The present invention is for a tool for use in aligning and leveling a vehicle door. A vehicle door typically has a door lock assembly which receives a lock pin on the door frame to secure the vehicle door in a closed position. Accordingly, the corresponding vehicle door typically includes a recess for accepting the lock pin on the door frame. The tool of the preferred embodiment includes an elongated member having a support member extending downwardly from the elongated member towards a vehicle door. The tool further includes a head member attached to the elongated member adapted to engage a vehicle door lock recess of a locking means of a vehicle door. The door leveler further includes a support plate attached to the support member adapted to rest against a vehicle door.

In another embodiment of the present invention, the elongated member may be configured with an ergonomic design to reduce burden on users of the door leveler. An ergonomic configuration of the elongated member may increase maneuverability of a vehicle door during the leveling process. The ergonomic configuration of the elongated member may include a series of bends in the elongated member. This ergonomic configuration lowers the user grip area from the head member allowing a user to gain more control and improve user lift ability. The ergonomic bends allow the grip area of the device to be substantially parallel while substantially lower than the working area of the vehicle door. Lowering the grip area allows a user of the door leveler to exert more force on the door leveler while minimizing risk of injury.

The vehicle door leveler is intended to assist in the lifting, pushing and pulling processes when aligning and leveling a vehicle door. The head member engages the vehicle door lock recess while the support plate simultaneously braces against the vehicle door. The user of the vehicle door leveler then uses the elongated member to pull or push the vehicle door in turn causing the vehicle door to move in accordance with proper alignment of the vehicle door.

A support member may extend downwardly from the elongated member to the vehicle door at various different points on the elongated member. The support member acts as a brace to further simplify use of the vehicle door leveler and to minimize burden on the user of the vehicle door leveler.

The support plate includes a front surface and a rear surface. The rear surface of the support plate is secured to the support member. The front surface of the support plate has a resilient surface adapted to prevent scratching of the paint or other damage to the vehicle door.

The foregoing and other objects, embodiments, features and advantages of the invention will become readily apparent from the following detailed description which proceeds with references to the accompany drawings.

DETAILED DESCRIPTION OF THE INVENTION

Figure 1:
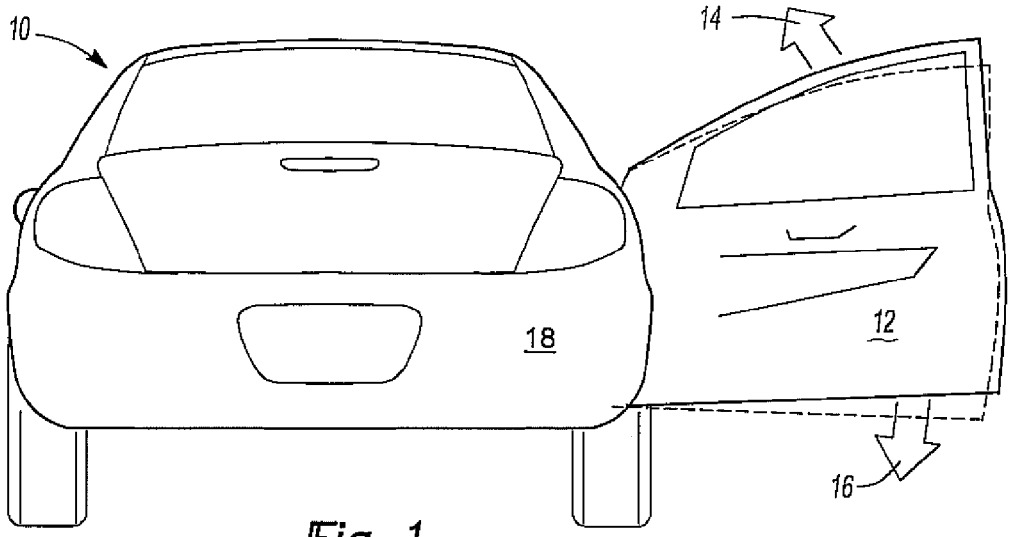
FIG. 1 is a plan view, in partial section, of a portion of the vehicle in which the apparatus of the current invention is being used to raise and lower the vehicle door.

The present invention is a tool for use in aligning and leveling a vehicle door. A vehicle door typically includes a door lock assembly which receives a lock pin on the door frame to secure the vehicle door in a closed position, as shown in FIG. 1. The corresponding vehicle door typically includes a recess for accepting the lock pin on the door frame. FIG. 1 depicts an idealized motor vehicle 10 having a vehicle body 18 on which vehicle door 12 is hingedly mounted. Vehicle autobody workers are often required to reposition the vehicle door 12 with respect to vehicle body 18 in order to properly align and level the vehicle door 12 with respect to vehicle body 18. Movement is accomplished when the user of the vehicle door leveler 20 pushes and pulls on the elongated member 24 of the vehicle of the vehicle door leveler 20 (as shown by movement arrows 14, 16). Said pushing of the vehicle door 12 facilitates the alignment process allowing workers to properly align the vehicle door 12.

The vehicle door leveler 20 in the embodiment here specifically disclosed is primarily formed of an elongated member 24, here shown in the form of a tubular shaft. Elongated member 24 may also be, but not limited to, in the form of a rectangular elongated member or other variations of an elongated member not otherwise depicted.

Elongated member 24 may optionally include a series of bends. Elongated member 24 bends are depicted at 52 and 54. Elongated member 24 may include between zero and four bends, not otherwise depicted in the drawings. The bends 52 and 54 are intended to improve usability to a user of the door leveler. This ergonomic configuration lowers the user grip area from the head member allowing a user to gain more control and improve user lift ability. The ergonomic bends allow the grip area of the device to be substantially parallel while substantially lower than the working area of the vehicle door. Lowering the grip area allows a user of the door leveler to exert more force on the door leveler while minimizing risk of injury.

Elongated member 24 may include more or less than the two bends 52 and 54 depicted in the drawings. Elongated member 24 may have a medial portion 38 between a grip portion 36 and a distal portion 40. Bends 52 and 54 may be provided at the joints of the medial portion 38, grip portion 36 and the distal portion 40. Bends 52 and 54 are discussed in further detail in this description.

Figure 2:
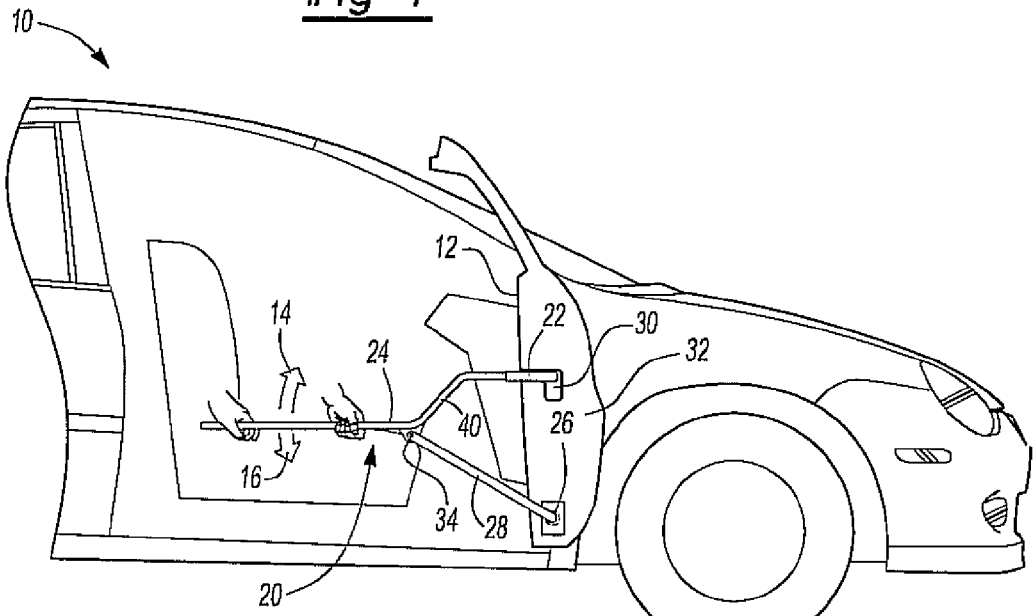
FIG. 2 is a perspective view of a first embodiment of the vehicle door leveler.
Figure 3:
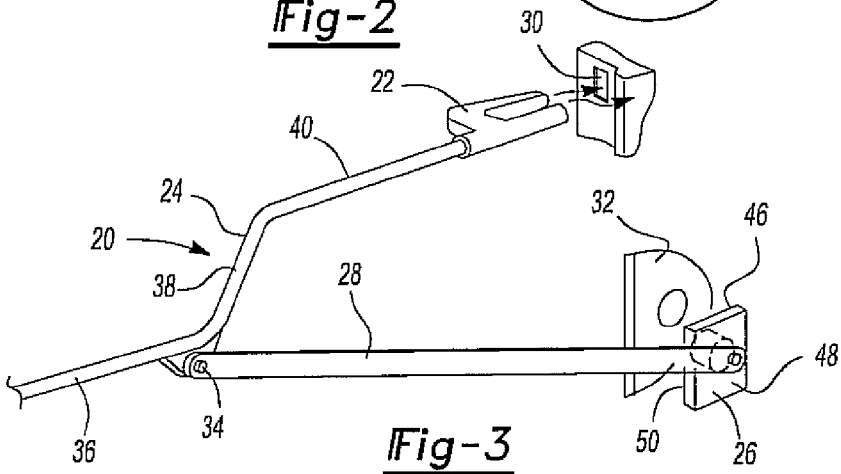
FIG. 3 is a side view diagram of a second embodiment of the vehicle door leveler.

Elongated member 24 includes a head member 22 adapted to engage a recess 30 on a side panel 32 of a vehicle door 12. Head member 22, as depicted in FIG. 2, may be U-shaped. Head member 22 could form several other different shapes including, but not limited to, a rectangular shaped head member, a circular shaped head member, a tubular shaped head member, etc.

Elongated member 24 further includes a support member 28 which extends downwardly from the elongated member 24 to the side panel 32 of the vehicle door 12. In one embodiment, support member 28 is fixedly secured to elongated member 24 at the joint 34. In another embodiment, support member 28 is rotatably mounted to elongated member 24 at the joint 34. The support member 28 is designed to minimize burden on the user of the vehicle door leveler 20. The support member 28 acts as a brace to further simplify use of the vehicle door leveler 20. The support member also provides an ergonomic benefit to the user of the vehicle door leveler 20 by reducing the force needed to raise and lower the vehicle door.

The vehicle door leveler is depicted in a series of embodiments shown in FIGS. 3-9. These various embodiments have different configurations of bends and support member placement. The limited list of embodiments shown in the drawings does not encompass all embodiments of the present invention. Generally, elongated member 24 is formed of a medial portion 38 between a grip portion 36 and a distal portion 40. Grip portion 36, medial portion 38 and distal portion 40 are formed of a single contiguous piece. Bends 52 and 54 may be provided at the joints of the medial portion 38, grip portion 36 and the distal portion 40. Bend 54 is measured by an angle 'x' as shown in FIGS. 3, 4, 5, 8 and 9 on the topside of the elongated member 24. Bend 52 is measured by an angle 'y' as shown in FIGS. 3, 4, 5, 8 and 9 on the underside of elongated member 24. Both angles 'x' and 'y' have a measure between 90°-270°. Bend 52 may also be measured by angle 'z' measured on the topside of the elongated member 24. Angle 'z' may have a measure between 60°-310°. Angles 'x', 'y' and 'z' are independent of each other and may have different measurements.

The first, second, third, fourth, seventh and eighth embodiments, as depicted in FIGS. 3, 4, 5, 8 and 9, respectively, include a series of two bends located at 52 and 54. In the first, second, third, fourth, seventh and eighth, angles 'x', 'y' and 'z' may have a measure between 90°-270°.

Figure 6:
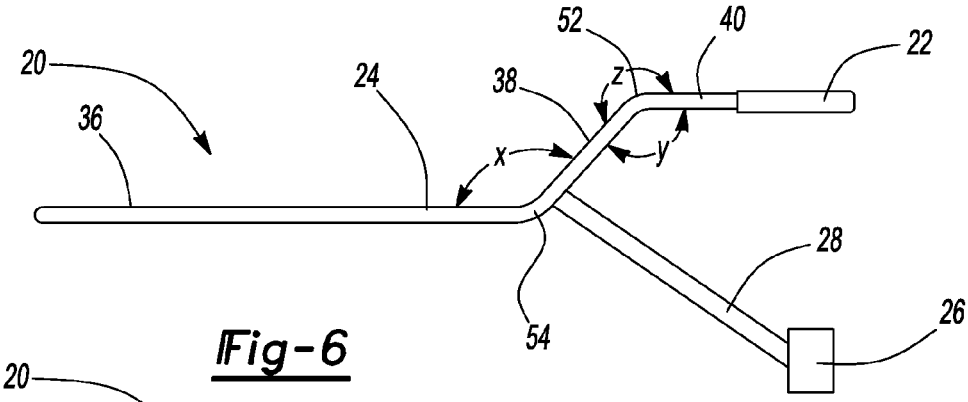
FIG. 6 is a side view diagram of a fifth embodiment of the vehicle door leveler.
Figure 7:
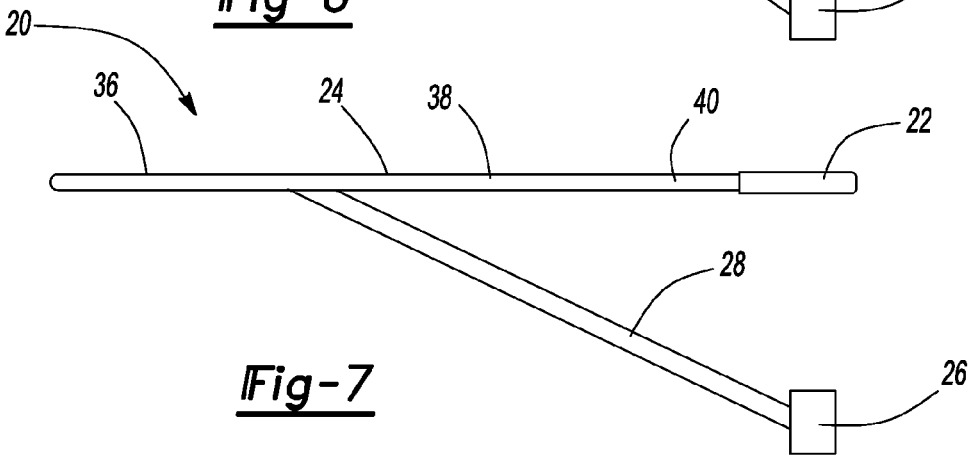
FIG. 7 is a side view diagram of a sixth embodiment of the vehicle door leveler.
Figure 8:
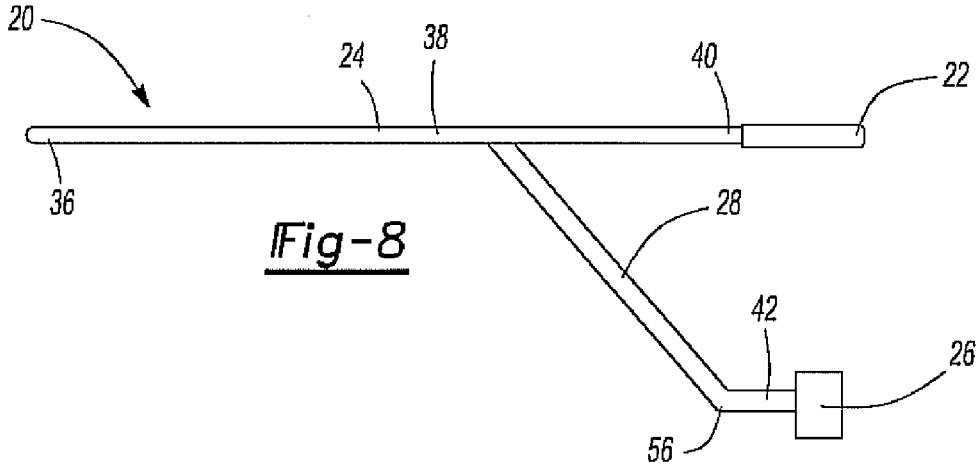
FIG. 8 is a side view diagram of a seventh embodiment of the vehicle door leveler.
Figure 9:
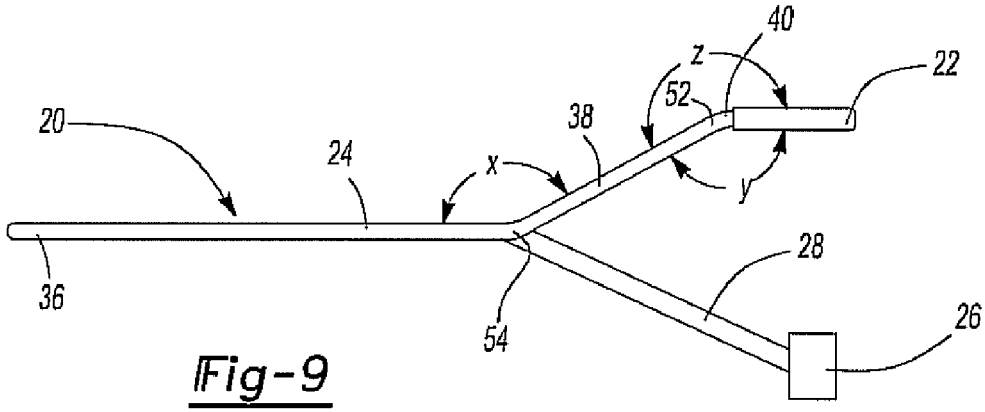
FIG. 9 is a side view diagram of an eighth embodiment of the vehicle door leveler.
Figure 10:
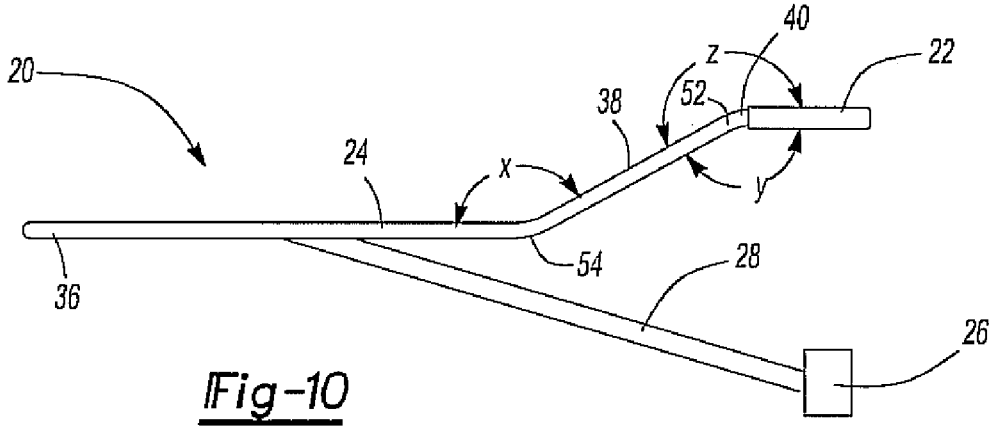
FIG. 10 is a side view diagram of a ninth embodiment of the vehicle door leveler.

As depicted in FIGS. 6 and 7, fifth and sixth embodiments, respectively, angles 'x', 'y' and 'z' may have a measure of 180°. When angles 'x', 'y' and 'z' have a measure of 180°, the elongated member 24 is perfectly straight.

Figure 4:
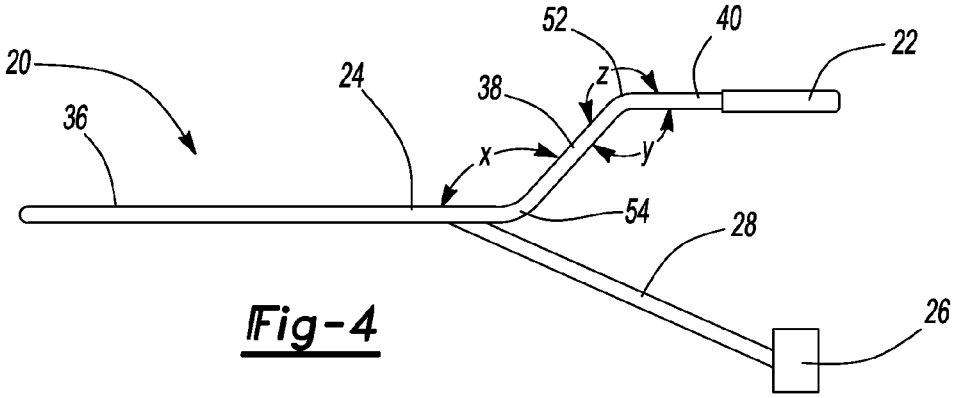
FIG. 4 is a side view diagram of a third embodiment of the vehicle door leveler.
Figure 5:
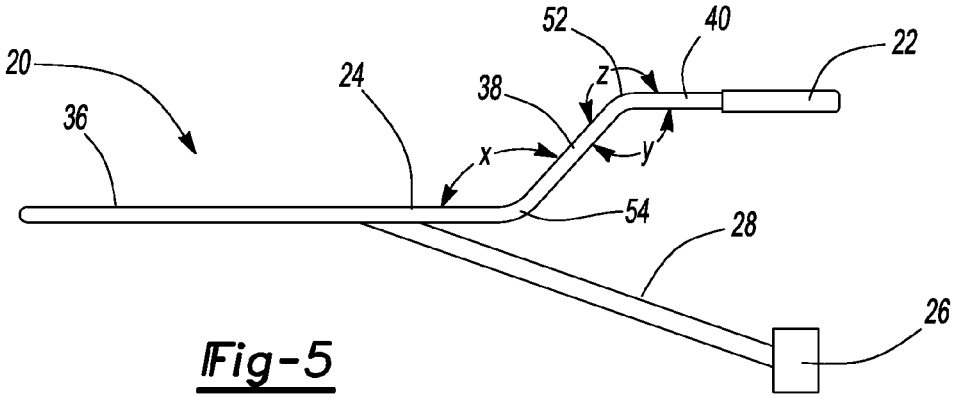
FIG. 5 is a side view diagram of a fourth embodiment of the vehicle door leveler.

The vehicle door leveler is depicted in a series of embodiments shown in FIGS. 4-10. These various embodiments have different configurations of support member 28 placement. Support member 28 placement on the elongated member 24 may vary. Placement of the support member 28 on the elongated member 24 may either be closer to the head member 22, centered on the elongated member 24, or closer to the grip portion 36. The support member 28 may also extend downwardly toward the vehicle door from the grip portion 36, the medial portion 38 or the distal portion 40 of the elongated member 24. For example, FIG. 3 (first embodiment), the support member 28 extends downwardly from the grip portion 36 of the elongated member 24. In FIG. 4 (second embodiment), the support member 28 extends downwardly from the grip portion 36 of the elongated member 24. In FIG. 5 (third embodiment), the support member 28 extends downwardly from the medial portion 38. Various placements of the support member 28 may improve user maneuverability.

Support member 28 includes a support plate 26. In the preferred embodiment, support plate 26 is fixedly secured to the support member 28. Support plate 26 may also be rotatably mounted about support member 28 or otherwise movable on support member 28. Support plate 26 includes a rear surface 48. Support plate 26 connects to support member 28 on a location on the rear surface 48 of the support plate 26. Support plate 26 also includes a front surface 46. Front surface 46 of support plate 26 is covered, at least partially, with a resilient surface 50. Resilient surface 50 may include, but is not limited to, a cloth material, flexible rubber or other polymer material, nylon, foam, cotton substrate . . . etc. Resilient surface 50 is designed to prevent scratching, denting, or other damage to the vehicle door 12.

As demonstrated by the use in FIG. 2, head member 22 is adapted to engage a recess 30 of a side panel 32 of a vehicle door 12. The operator of the vehicle door leveler 20 may either lift or push down on the vehicle door leveler 20 to attain the proper level and alignment of the vehicle door 12. Support member 28 and support plate 26 are adapted to engage the side panel 32 of the vehicle door 12. The support member 28 acts as a brace to further simplify use of the vehicle door leveler 20. The support member also provides an ergonomic benefit to the user of the vehicle door leveler 20 by reducing the force needed to raise and lower the vehicle door.

FIG. 7 depicts yet another embodiment wherein support member 28 includes a support member bend 56. Support member bend 56 may improve usability for the user of the vehicle door leveler. The bend may reduce the ergonomic burden on the user of the vehicle door leveler.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

We claim:

1. A vehicle door leveler, for use with a vehicle of the type having a door mounted on vertical hinges along one side and having a locking member on an opposite side of said vehicle door, comprising:

an elongated member;

a head member attached to said elongated member adapted to engage a vehicle door lock recess of said locking member of said vehicle door;

a support member extending downwardly from said elongated member towards said vehicle door; and a support plate attached to said support member, the support plate having a resilient surface adapted to rest against said vehicle door.

2. The vehicle door leveler of claim 1 wherein said elongated member is formed of a single contiguous piece.

3. The vehicle door leveler of claim 1 wherein said elongated member includes a series of zero to four bends along the length of the elongated member.

4. The vehicle door leveler of claim 3 wherein said bends each have a predetermined angle.

5. The vehicle door leveler of claim 4 wherein said predetermined angles lie in a common horizontal plane.

6. The vehicle door leveler of claim 5 wherein said predetermined angles are formed on a topside of said elongated member.

7. The vehicle door leveler of claim 5 wherein said predetermined angles measure between 60°-310°.

8. The vehicle door leveler of claim 1 wherein said head member is attached to said elongated member.

9. The vehicle door leveler of claim 8 wherein said head member is fixedly secured to said elongated member.

10. The vehicle door leveler of claim 1 wherein said support member may include a series of one to four support member bends wherein said support member bends each have a predetermined angle.

11. The vehicle door leveler of claim 10 wherein said predetermined angles are formed on a topside of said support member.

12. The vehicle door leveler of claim 11 wherein said predetermined angles measure between 90°-270°.

13. The vehicle door leveler of claim 1 wherein said support plate includes a front surface and a rear surface.

14. The vehicle door leveler of claim 13 wherein said rear surface of said support plate is secured to said support member.

15. The vehicle door leveler of claim 14 wherein said front surface of said support plate includes the resilient surface adapted to prevent damaging a surface of said vehicle door.

16. A vehicle door leveler, for use with a vehicle of the type having a door mounted on vertical hinges along one side and having a locking member on an opposite side, the vehicle door having a vehicle door lock recess and a planar door surface lying in a common vertical plane, comprising:

an elongated rigid member having a head member, an intermediate portion, and a handle member;

a support member having a first end and a support end, the support member to extend below the elongated rigid member, the first end of the support member pivotally connected to the elongated rigid member, the support member extending downwardly towards the vehicle door when the leveler is in use; and the head member of the elongated rigid member operable to engage the door lock recess, the support end of the support member operable to engage the planar door surface, the head member of the elongated rigid member and the support end of the support member lying in a parallel vertical plane when the leveler is in use.

17. The vehicle door leveler of claim 16 wherein the elongated rigid member includes a series of zero to four bends along the length of the elongated rigid member.

18. The vehicle door leveler of claim 17 wherein said bends each have a predetermined angle.

19. The vehicle door leveler of claim 18 wherein said predetermined angles lie in a common horizontal plane.

20. The vehicle door leveler of claim 19 wherein said predetermined angles are formed on a topside of said elongated rigid member.

21. The vehicle door leveler of claim 20 wherein said predetermined angles measure between 60°-310°.

* * * * *